United States Patent [19]

Santic

[11] 4,011,810

[45] Mar. 15, 1977

[54] GARBAGE DISPOSAL UNIT

[75] Inventor: Blaz Santic, Burgau, Germany

[73] Assignee: Karl Mengele & Sohne, Gunzberg, Germany

[22] Filed: Dec. 23, 1975

[21] Appl. No.: 643,870

[30] Foreign Application Priority Data

Dec. 23, 1974 Germany ..... 2461242

[52] U.S. Cl. ..... 100/229 A; 100/203; 100/209; 100/DIG. 15

[51] Int. Cl.[2] ..... B30B 7/02; B30B 15/06

[58] Field of Search ..... 100/137, 209, 229 R, 100/229 A, DIG. 15, 194, 203, 240; 141/73, 80

[56] References Cited

UNITED STATES PATENTS

| | | | |
|---|---|---|---|
| 3,528,366 | 9/1970 | Neuenburg et al. | 100/DIG. 15 |
| 3,685,438 | 8/1972 | Ziegler | 100/229 A |
| 3,717,089 | 2/1973 | Oles et al. | 100/DIG. 15 |
| 3,862,593 | 1/1975 | Engebretsen | 100/229 A |

FOREIGN PATENTS OR APPLICATIONS

| | | | |
|---|---|---|---|
| 979,016 | 12/1950 | France | 100/203 |
| 435,189 | 10/1926 | Germany | 100/209 |

*Primary Examiner*—Richard E. Aegerter
*Assistant Examiner*—Richard R. Stearns
*Attorney, Agent, or Firm*—Toren, McGeady and Stanger

[57] ABSTRACT

A garbage disposal unit is provided with a stationery compacting piston fixed at the upper end thereof and with a fixed receptacle member at the lower end thereof. A movable combination member adapted to act as both a receptacle and a compacting piston is mounted intermediate the fixed piston and the fixed receptacle. The disposal unit is thus capable of separately handling different types of garbage, with bottles, cans and the like being placed within the movable combination member to be compacted by upward movement thereof for compacting engagement with the upper fixed piston. Ordinary foodstuffs may be placed within the fixed receptacle at the bottom of the unit and movement of the combination member downwardly enables utilization of the combination member as a compacting piston for crushing garbage within the lower fixed receptacle.

9 Claims, 3 Drawing Figures

GARBAGE DISPOSAL UNIT

BACKGROUND OF THE INVENTION

The present invention relates generally to garbage disposal units and more particularly to units which operate to crush or compact garbage and other waste materials by operation of a compacting piston within a tank or receptacle containing the garbage. Units of the type to which the present invention relates generally include spindles through which compacting forces generated by an electric motor or the like are transmitted in order to provide the compacting pressure for the unit.

In known home garbage disposal units, the garbage is normally placed within a tank or receptacle which is located beneath a compacting piston and which essentially represents a bottom die within which the garbage is compacted by movement of the piston downwardly into the receptacle. In many cases, the receptacle may be lined with a foil bag.

As the quantity of garbage or waste material accumulated in the bottom receptacle member increases, the size of the compressed mass of garbage becomes larger and displays greater recoil or resilient characteristics thereby making it more difficult to crush or compact added material. Thus, solid waste materials such as bottles, cans or the like, can no longer be adequately compressed or crushed within the disposal apparatus.

A further consideration relates to the likelihood of damage of material which is used as a lining for the receptacle member. Ordinarily, foil bags of the like used to line the receptacle may be easily damaged by solid waste materials, such as glass or metal parts. As a result, fluid which becomes separated from the solid components of the garbage during the pressing operation may be discharged into the openings or ruptures formed in the lining material thereby giving rise to the creation of foul odors. Spraying of deodorizing substances normally utilized within disposal units is generally ineffective to remedy such a situation.

Accordingly, garbage disposals of the prior art have been found as failing to meet many of the requirements which arise in the compacting of garbage and waste materials, particularly in the home.

Additionally, conservation considerations have imposed further requirements upon the operating characteristics of garbage disposal units. With the desirability for recycling many of the raw materials found in waste products, conservation of such raw materials becomes more and more important. However, such recycling necessarily involves the requirement that the waste materials be sorted in order to enable their processing in a manner which renders them available for subsequent use. However, sorting of the waste materials at the collecting points has been found to be extremely costly.

Accordingly, the present invention is intended to provide a garbage disposal unit giving rise to several advantages over prior art devices. One important consideration involved in the features imparted to the present invention is the need for enabling a convenient sorting of garbage in the home. Further considerations, such as improvement in the garbage compacting characteristics during operation of the garbage disposal unit are also involved. Accordingly, the present invention is directed toward providing a solution for the problems arising when it is desired to provide a garbage compacting mechanism having improved compacting efficiency, particularly with regard to bottles, cans and the like while also making it possible to easily and efficiently sort the waste materials which are to be disposed of and to prevent damage to the plastic liners for the receptacle members of such disposal units.

SUMMARY OF THE INVENTION

Briefly, the present invention may be described as a garbage disposal unit which comprises a compacting piston member which is fixedly mounted within the unit near the upper end thereof, a garbage receptacle member fixedly mounted near the lower end of the disposal unit and a combination member adapted to operate both as a piston and as a receptacle which is mounted intermediate the fixed piston member and the fixed receptacle member and which is movable vertically to engage both the upper fixed piston member and the lower fixed receptacle member.

The combination member, in view of the fact that it operates both as a piston member and as a receptacle member, may have garbage deposited therein and by upward movement of the combination member into engagement with the upper fixed piston member, the garbage deposited in the combination member may be compacted. By subsequent movement of the combination member downwardly into engagement with the lower fixed receptacle member, garbage contained within the lower receptacle member may be also compacted by operation of the combination member as a compacting piston.

The fixed piston member, the fixed receptacle member and the movable combination piston-receptacle member are configured to enable interfitting nesting engagement thereof. Drive means are provided for driving the combination member between its two operating positions and the drive means may conveniently include a motor which is housed within the fixed upper compacting piston member.

Both the lower fixed receptacle member and the movable combination piston-receptacle member may be mounted within the disposal unit as drawers which may be pulled outwardly of the unit when a closure member or door of the unit is opened.

Spindles are provided in the disposal unit upon which the movable combination member is mounted and by operation of a spindle drive the combination member may be raised to its upper position for compacting engagement with the upper fixed piston and to its lower position for compacting engagement with the lower fixed receptacle member.

The structure and arrangement of the garbage disposal unit in accordance with the present invention makes it possible to provide one receptacle for organic waste materials such as foodstuffs or leftovers, with another receptacle member being provided for solid waste such as bottles, cans or the like.

Thus, by the present invention there is achieved the capability for enabling easy sorting of the garbage in that organic waste materials may now be compacted separately without encountering the risk of damage to the plastic liners which are usually inserted into a receptacle member for containing the fluids which are emitted when such organic waste materials are compacted. In view of the fact that, in the receptacle member containing the organic waste materials, no solid waste such as bottles, cans or the like need be treated, damage to the liner is avoided and the fluid components squeezed from the organic wastes, which can in some cases comprise about 30% of the volume of the material to be treated, cannot escape from the receptacle because of damage to the liner material. Thus, foil odors which are very difficult to eliminate will not be created.

Additionally, advantages arise by virtue of the fact that an improved overall degree of compaction results from the ability for treating different types of waste materials separately. A greater storage efficiency is realized and the receptacle tanks need not be emptied as often as would usually be required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 2:
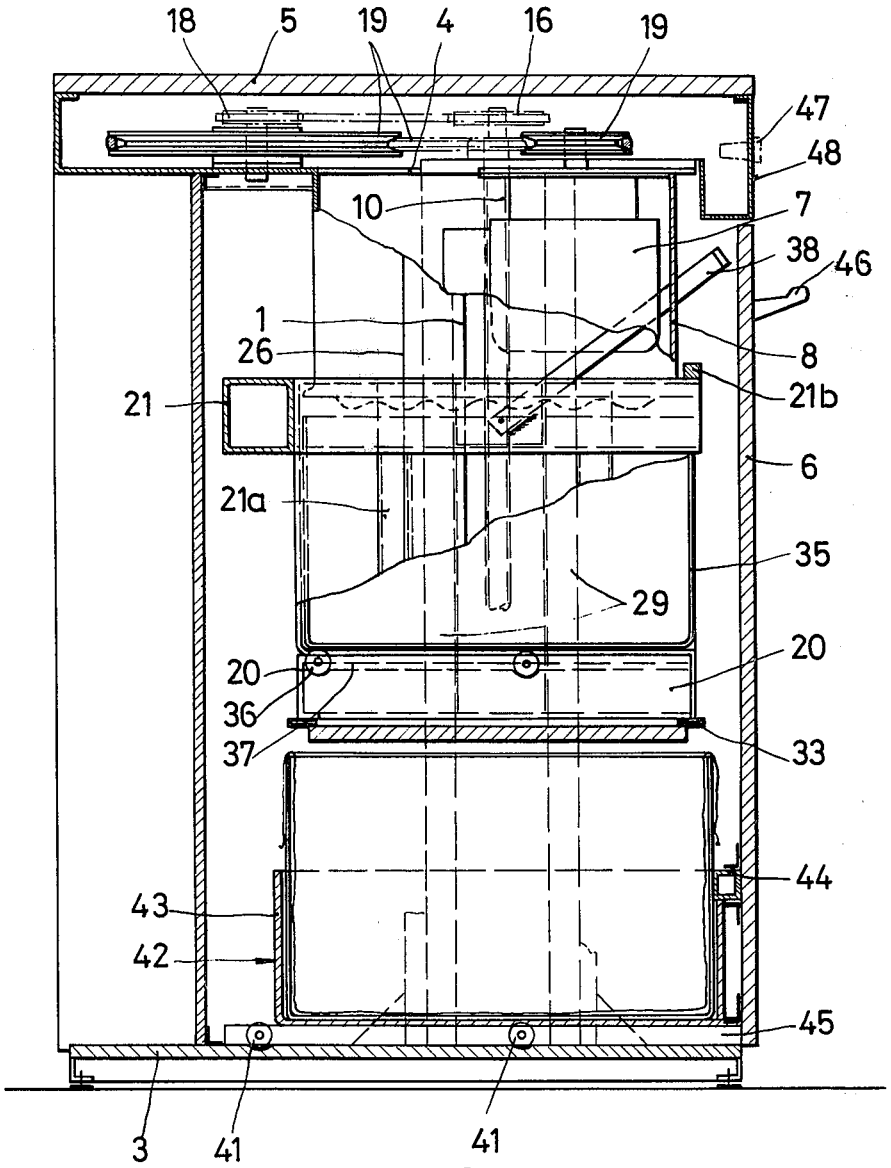
FIG. 2 is a schematic side elevation of the unit of FIG. 1.
Figure 3:
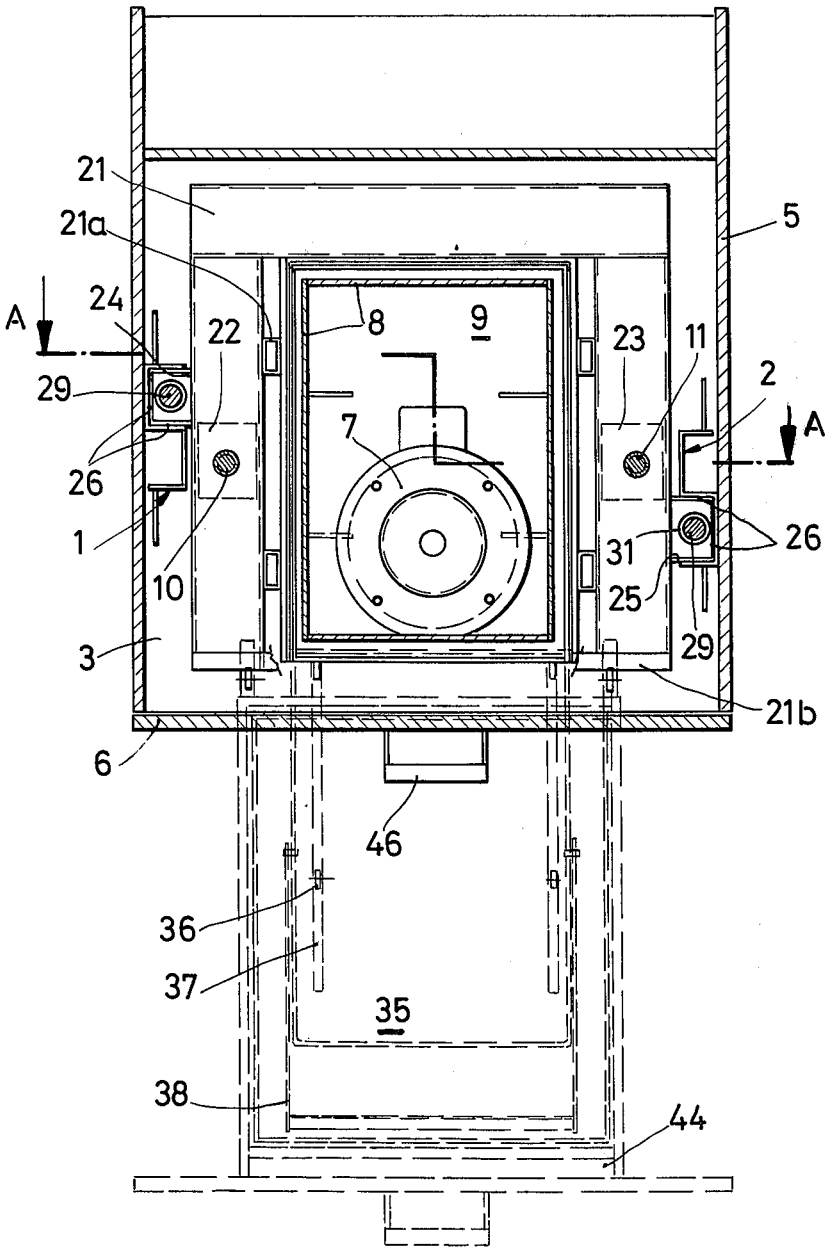
FIG. 3 is a top sectional view taken along the line B—B of FIG. 1.

Referring now to the drawings, wherein like reference numerals are used to designate similar parts throughout the various figures thereof, there is shown a garbage disposal unit including a pair of vertical support members 1 and 2 which form a door frame and which are joined to a bottom or base plate 3. At the upper end of the unit there is provided a mounting plate 4 and a housing 5 of the unit supports a door 6 at the front of the unit, as best seen in FIGS. 2 and 3.

A drive motor 7 is attached to the underside of the mounting plate 4 and a housing 8 encloses the motor 7.

In accordance with the principles of the present invention, the bottom of the housing 8 is designed to operate as a compacting piston member 9 and to thereby provide at the upper end of the disposal unit a fixed compacting piston member whose mode of operation will be more fully described hereinafter.

The unit also contains a pair of vertical spindles 10 and 11 mounted upon thrust bearings 12 and 13 in the base plate 3 with radial thrust bearings 14 and 15 being provided in the mounting plate 4. The spindles 10 and 11 are driven by a V-belt drive 19 connected by means of sprocket wheels 16 and 17 as well as by an intermediate sprocket wheel 18 to the motor 7.

Disposed immediately below the upper fixed piston member 9 there is provided a vertically movable combination piston-receptacle member composed of a compacting piston member 20 and a receptacle member 35. As will be more fully described hereinafter, the piston 20 and the receptacle 35 are essentially movable piston and receptacle members, respectively, which are operated by actuation of the drive mechanism of the invention to effect the compacting operation of the unit.

The movable compacting piston member 20 disposed below the fixed piston 9 is connected by means of a box-like yoke **21*a* and a frame 21 to a pair of spindle nuts 22 and 23 of the spindles 10, 11. The yoke 21*a* is provided with lateral guide means 24 and 25 (See FIG. 3) which slide within bent-guideways 26 (See FIGS. 2 and 3) of the uprights 1 and 2**.

Firmly mounted within a pair of bushings 27 and 28, which are located in the base plate 3 and in the mounting plate 4, respectively, are guide rods 29 which are enclosed by bearing sleeves which are likewise joined to the yoke **21*a*. These are provided on the top and the bottom with ball bearings 30 and 31 whose ball members are supported by the guide rods 29**.

Both the fixed piston 9 and the movable piston 20 are provided with a stripper bead 32 and 33 respectively, which extend about the lower peripheries of the pistons and which may be expediently made of an elastic or resilient material.

Additionally, the stationery piston 9 is provided with rib means 34 on its lower compacting surface.

The frame 21 of the movable piston 20 which is open in the direction of the door 6 (See FIGS. 2 and 3) is closed by a bridge member **21*b* and supports the movable receptacle member 35. The receptacle member 35 is arranged with a hinged handle 38 enabling it to be pulled outwardly toward the open side of the unit (See FIGS. 2 and 3) by rolling engagement of roller bearing guide elements 36 in rails 37**.

Figure 1:
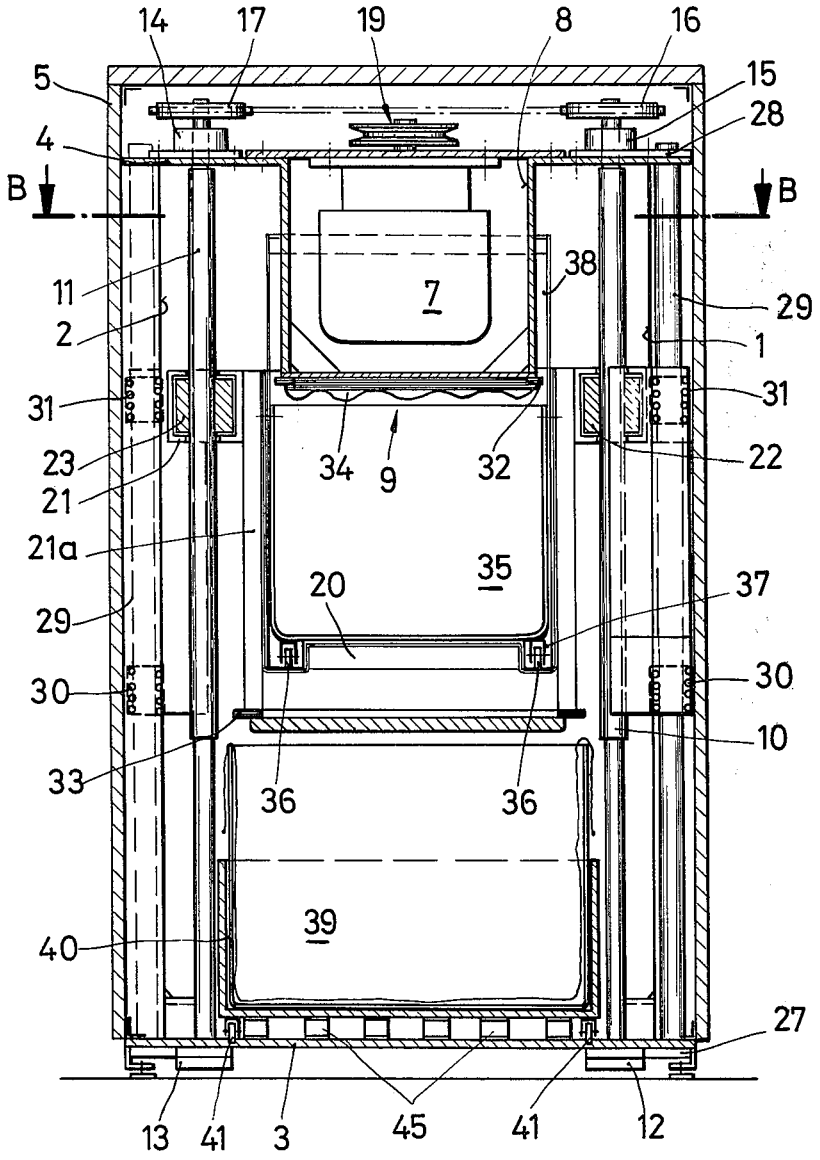
FIG. 1 is a sectional front elevation of a garbage disposal unit in accordance with the present invention taken along the line A—A of FIG. 3.

Below the movable piston 20, there is provided a second receptacle member in the form of a fixed receptacle member 39. The fixed member 39 is arranged in a carriage 42 provided with a guide element 40 and rollers 41 (See FIGS. 1 and 2) and it may be pulled outwardly in the form of a drawer with the carriage 42 having side walls 43 extending thereabout. The door 6 is mounted to the carriage 42 by means of brackets 44 and 45. A handle 46 is mounted to the door 6.

The disposal unit may be provided with push button switches 47 which operate or control the disposal unit and which are mounted in a front panel 48 of the unit.

Operation of the garbage disposal unit of the invention is initiated by actuation of the starting switches 47. Actually, the switches 47 comprise two switch elements by means of which the movable combination member comprising the piston 20 and the receptacle 35 may be actuated so as to either rise upwardly to enclose the housing 8 and the upper fixed piston member 9 or to move downwardly into the lower fixed receptacle 39. By elevation of the combination member, the fixed piston 9 will operate to compact garbage contained within the receptacle 35. When the combination member is lowered into the receptacle member 39, the piston 20 will compact garbage contained therein. Naturally, the correct positions of the receptacle members are made secure both mechanically and electrically.

In the operation of the device it is expedient to utilize the movable receptacle member 35 for compacting solid articles such as bottles, cans or other similar material which are more difficult to compress. Because of the smaller compacting surface which is provided, greater pressures per unit area are created within the movable receptacle 35 than those created by the movable piston 20 within the receptacle member 39. This provides a particularly favorable effect with regard to the crushing of solid glass articles such as bottles which are placed adjacent each other and which would otherwise be crushed only in the presence of stronger driving forces.

The fixed receptacle member 39 is intended primarily for use in treating organic waste materials such as kitchen scraps, food leftovers and the like. Since these are a more frequent occurrence, the lower fixed receptacle member 39 is mounted to be pulled outwardly of the unit together with the carriage 42 each time that the door 6 is opened.

It will be apparent that there may also be provided more than two spindles and, for example, three spindles may be provided, making it thus possible to conserve wear upon the guide elements 29, 30 and 31. The elements of the unit may then be arranged so that almost the entire compacting piston area will be located within a triangular support area in order to avoid spindle tilting loads of greater magnitude.

In the present case, such side loads are absorbed by the ball bearings 30 and 31 which, under normal use, are supported by the guide rods 29. When extreme tilting forces are generated, an additional safety measure is provided by the housing of the compacting piston 20 which supports itself directly against the guide ways 26 of the uprights 1 and 2.

In the drawings, the movable piston 20 is depicted in its ready position. In this position, the door 6 may be opened by gripping the handle 46 and kitchen wastes, food leftovers and other organic waste materials may be deposited in the lower fixed receptacle member 39. Bottles, cans and similar types of garbage are placed within the movable receptacle member 35 after it has been pulled out of the unit by gripping the handle 38. Both of the receptacle members 35 and 39 may be returned into their operating positions upon closing of the door 6.

After the receptacle members 35 and 39 have been appropriately loaded, the starter switches 47 may be actuated. The circuit arrangement for operating the unit of the invention is arranged such that the compacting piston 20 and its associated receptacle member 35 move in the upward direction. The fixed piston 9 becomes immersed within the receptacle member 35 to a sufficient depth for actuation of an electrical switch (not shown) which triggers a reversal of the direction of rotation of the motor 7 at a predetermined current density after compaction of the contents of the receptacle member 35.

Inasmuch as both of the starter switches 47 were initially actuated, the compacting piston 20 will then move downwardly and become immersed in the receptacle member 39 in order to compress the waste materials collected therein. When a predetermined current density for this portion of the work cycle is achieved, the direction of rotation of the motor 7 is again reversed by a similar electric switch (not shown) thereby returning the movable combination member including the receptacle 35 and the piston 20 to its ready position.

The stripper bead 33 of the movable piston 20 engages with the upper rim of receptacle member 39 in order to form a slidable seal as the compacting piston becomes immersed into the receptacle member 39 or is lifted as the piston moves outwardly of the member 39. As a result an additional effect is obtained in that, if the piston is stopped with the bead 33 engaged within the member 39, the member 39 will be maintained in a sealed condition. Thus, the circuit mechanism and actuating control elements of the invention may be arranged so that the piston 20, in the normal position of its work cycle, is maintained at a location with the bead 33 sealing the receptacle 39 so that odor-forming substances cannot escape and penetrate the environment around the disposal unit. The circuit arrangement is such that the door 6 may be readily opened after actuation of the operating switches by return of the compacting piston 20 into the position depicted in FIG. 1 so that the work cycle may be repeated.

The ribs 34 provided beneath the fixed piston 9 operate to enhance the compacting effect which is achieved in treating the waste materials contained within the movable receptacle member 35. The ribs are capable of providing an improved crushing operation particularly with regard to glass parts or the like. Since the ribs 34 will tend to break up glass members such as bottles, bursting or similar effects may be avoided.

The lower fixed receptacle member 39, which is intended for treating softer wastes such as foodstuffs may be provided with a foil bag acting as a liner to prevent escape of fluid components of the garbage. The foil bag may be retained within the receptacle 39 by means of a peripheral bead provided thereabout and fitted in order to enable proper sealing engagement of the bag contained therein. Furthermore, when the piston member 20 moves outwardly of the receptacle 39, a vacuum effect will be created by the piston thereby serving to evacuate air from the receptacle cavity so that an incipient fermenting or rotting process is interrupted or will be retarded. In the invention, appropriate firm seating of the foil bag is obtained by the provision of an external peripheral bead about the receptacle members against which there may rest a rubber ring or the like associated with the foil bags which can be slipped over the bead and thereby firmly held in place.

While specific embodiments of the invention have been shown and described in detail to illustrate the application of the inventive principles, it will be understood that the invention may be embodied otherwise without departing from such principles.

What is claimed is:

1. A garbage disposal unit comprising frame means defining said disposal unit with an upper end and a lower end, a stationary compacting piston fixedly mounted to said frame means near the upper end of said disposal unit, a stationary receptacle member mounted near the lower end of said disposal unit, a combination piston-receptacle member movably mounted intermediate said stationary piston and said receptacle member, means mounting said combination member for vertical movement within said disposal unit to effect compaction of material contained within said combination member by said piston and compaction of material contained within said receptacle member by said combination member, said piston, said combination member and said receptacle member being configured for nesting interfitting relationship therebetween, and drive means for driving said combination member between operative engagement with said piston and said receptacle member.

2. A unit according to claim 1 wherein said mounting means comprise spindles having said combination member mounted thereupon for driving engagement therewith, and wherein said drive means comprise a motor for driving said combination member along said spindles, said motor being housed within said piston at the upper end of said disposal unit.

3. A unit according to claim 1 including a door mounted to open and close said unit, means for enabling said receptacle member to be moved inwardly and outwardly of said unit in the form of a drawer, and means for moving said receptacle member outwardly of said unit simultaneously with actuation of said door to open said unit.

4. A unit according to claim 3 wherein said combination member is mounted to be moved inwardly and outwardly of said unit.

5. A unit according to claim 4 including a hinged handle mounted to said combination member to enable said combination member to be independantly moved outwardly of said unit for filling thereof.

6. A unit according to claim 1 wherein said combination member is structured in a generally box-like configuration having an open top and a closed bottom member with the outside of said bottom member being a compacting piston to crush garbage contained within said receptacle member.

7. A unit according to claim 1 wherein said piston contains rib means protruding therefrom to enhance the crushing effect of said piston upon material contained within said combination member.

8. A unit according to claim 1 wherein said piston and said combination member are each provided with a resilient sealing strip extending about the lower periphery thereof to effect a generally sealing sliding engagement between said compacting piston and said combustion member, and between said combination member and said receptacle member, respectively, when said members are moved into compacting engagement with each other.

9. A unit according to claim 1 including a door operable to open and close said unit, wherein said combination member includes a sealing strip extending about the lower periphery thereof to effect sliding sealing engagement between said combination member and the internal walls of said receptacle member when said combination member moves into said receptacle member, and wherein said drive means comprise circuit means defining an operating cycle for said combination member which includes as a normal stop position of said combination member a position wherein said sealing strip is in sealing engagement between said combination member and said receptacle member, said circuit means further comprising switch means for actuating movement of said combination member out of engagement with said receptacle member.

* * * * *